US007009513B2

(12) United States Patent
Dang

(10) Patent No.: US 7,009,513 B2
(45) Date of Patent: Mar. 7, 2006

(54) INHERENTLY DEPLOYABLE WARNING TO ALARM OF AN OPENING INTO THE TOP OF A SUB-GRADE STRUCTURE

(75) Inventor: Nguyen Thai Dang, Pomona, CA (US)

(73) Assignee: Carson Industries, LLC, Glendora, CA (US)

( * ) Notice: Subject to any disclaimer, the term of this patent is extended or adjusted under 35 U.S.C. 154(b) by 211 days.

(21) Appl. No.: 10/746,186

(22) Filed: Dec. 24, 2003

(65) Prior Publication Data

US 2005/0146440 A1 Jul. 7, 2005

(51) Int. Cl.
*G08B 13/08* (2006.01)

(52) U.S. Cl. ..... 340/545.1; 340/540; 40/608; 116/270

(58) Field of Classification Search ..... 340/545.1; 40/608; 116/63 R
See application file for complete search history.

(56) References Cited

U.S. PATENT DOCUMENTS

| | | | | |
|---|---|---|---|---|
| 4,019,271 | A * | 4/1977 | Latimer | 40/603 |
| 6,095,081 | A * | 8/2000 | Gochenour | 116/209 |
| 6,149,340 | A * | 11/2000 | Pateman | 404/10 |
| 6,305,312 | B1 * | 10/2001 | Bent et al. | 116/63 P |
| 2004/0244670 | A1 * | 12/2004 | Young | 116/63 R |

* cited by examiner

*Primary Examiner*—Jeffery Hofsass
*Assistant Examiner*—George A Bugg
(74) *Attorney, Agent, or Firm*—Donald D. Mon

(57) ABSTRACT

A signal to warn of the open condition of a sub-grade vault whose lid may be open or missing. A spring-loaded placard is held down in the vault by a closed lid and raises above the opening by its own stored energy when the lid is open or m issing.

11 Claims, 3 Drawing Sheets

INHERENTLY DEPLOYABLE WARNING TO ALARM OF AN OPENING INTO THE TOP OF A SUB-GRADE STRUCTURE

FIELD OF THE INVENTION

A passive device for indicating and warning about the fact of an open entry into a sub-grade structure and about the risks which its open condition might involve.

BACKGROUND OF THE INVENTION

Sub-grade structures, or vaults, as the term is alternatively used herein, are open-topped structures with an internal cavity. It is common practice for such vaults to be placed where persons can be expected to walk, or where vehicles are to travel. They are used for a multitude of purposes, among them being terminal boxes for electrical cables, communication cables, collectors for drainage of surface water such as caused by draining basins, area drainage collectors for storm water sewer system, surface receptacles for hoses, and manhole and equipment entry ports for any of these.

It is common practice to place a cover on the top of the vault to close it. The cover is intended to protect a person or vehicle from falling into the it at the risk of physical injury from a fall, or exposure to electrical hazard, and to protect the contents of the vault from theft or vandalism. Absence of the cover exposes the person, vehicle, and vault contents to such risks.

One could reasonably expect that a pedestrian or driver would look to see where they are stepping or driving and should notice the relatively large hole that exists when the cover is missing, and avoid it. The realities of litigation suggest that this expectation should not be relied on, but rather that pro-active efforts be made to provide a visual warning that the cover is missing.

Also, such a warning could usefully be transmitted to a supervisory system that can alert the operator to the absence of the cover, and more importantly, to the existence of a vault with its top open and its contents exposed.

It is an object of this invention to provide a passive device which is out of sight and restrained when a cover is properly in place, but which, when the cover is open or missing, will by its own mechanically stored energy immediately rise to provide an above ground visible indicia adjacent to, above, and perhaps also over the opening, so as to alert persons to the fact of an open vault. It can be held down and out of sight only by a cover properly in place on the top of the vault.

BRIEF DESCRIPTION OF THE INVENTION

This invention is used in combination with a sub-grade structure (for convenience called a "vault") having a peripheral sidewall, an open top with a rim, and sometimes a bottom. It forms a cavity below the rim. A cover is adapted to rest on the rim to close the open top. The cover may or may not be partially attached to the rim, such as by a separable hinge. Most often it will be completely removable.

A warning device according to this invention is hinged to the vault at or adjacent to the rim. It is spring-loaded toward an upright position, and can resiliently be pressed into the cavity and held there passively by a properly positioned cover. When the cover is removed, the device will be moved by its own mechanically stored energy to its upright deployed position, and there it will display a visible warning placard which it carries.

According to a preferred but optional feature of this invention, the placard is formed in a shape which will be clearly visible from all sides, and may carry a warning message as well as a vivid coloration.

According to an optional feature of the invention, the placard may be a deployable structure, for example a folded structure which opens to provide for visibility in all directions. This deployability is the consequence of a springy relationship between some of its parts.

According to another optional feature of the invention, a warning system such as an automatic telephone dialer or a typical intrusion wireless alarm can be included in the system which deploys the placard The above and other features of this invention will be fully understood from the following detailed description and the accompanying drawings, in which:

BRIEF DESCRIPTION OF THE DRAWINGS

FIG. 2 is a fragmentary cross-section of the vault of FIG. 1 with the cover on;

FIG. 5 is a fragmentary view as in FIG. 2 with a different placard and the cover on;

DETAILED DESCRIPTION OF THE DRAWINGS

Figure 1:
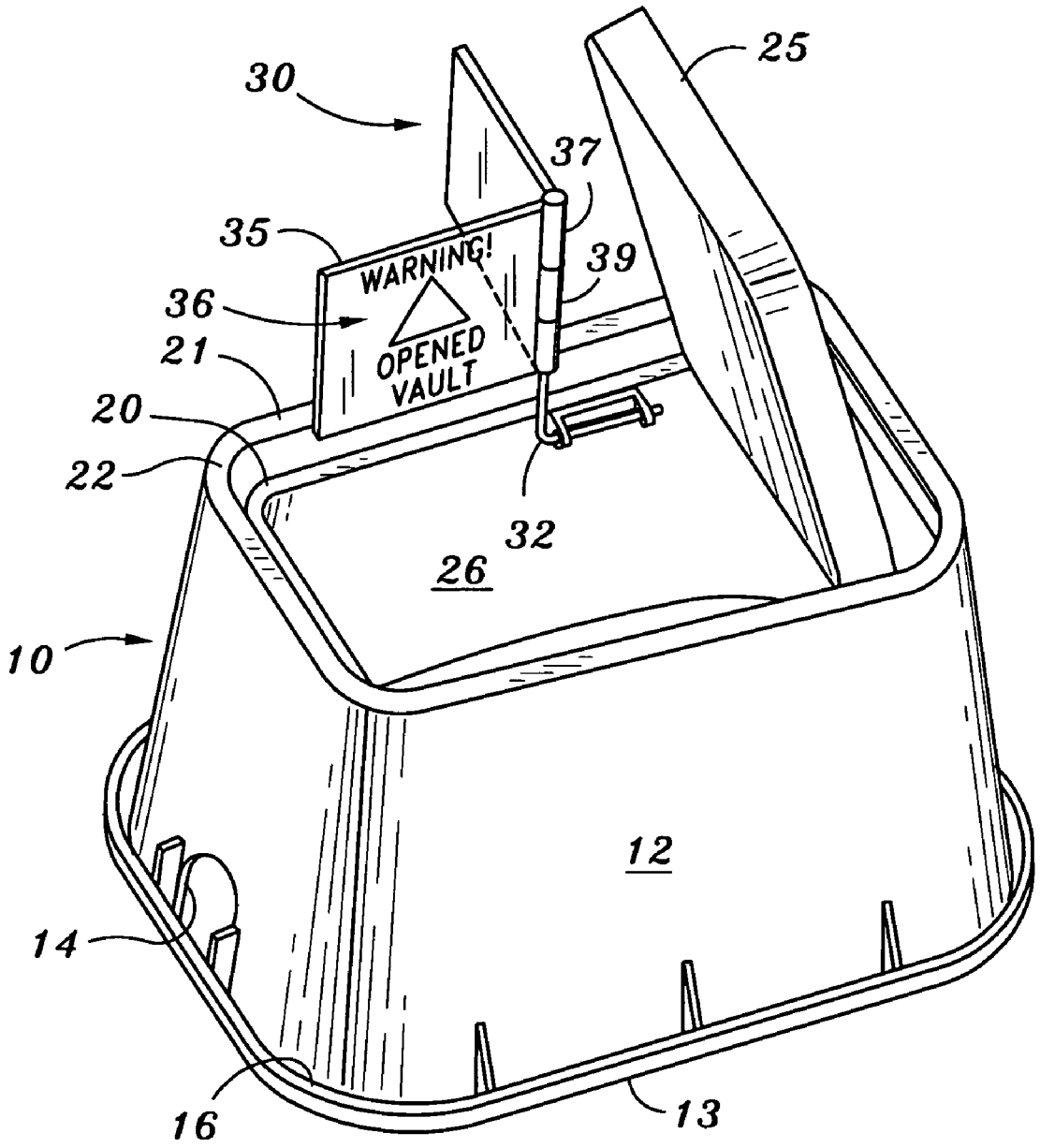
FIG. 1 is a perspective view of a vault with a warning device according to the invention.
Figure 2:
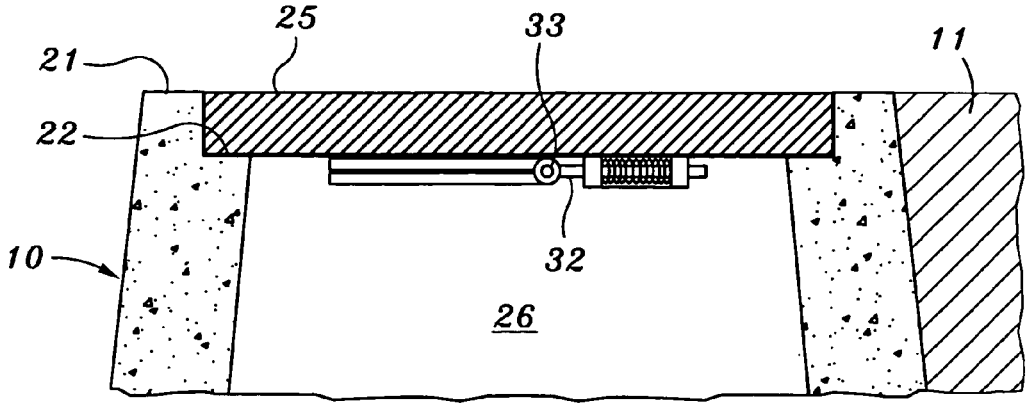
Figure 3:
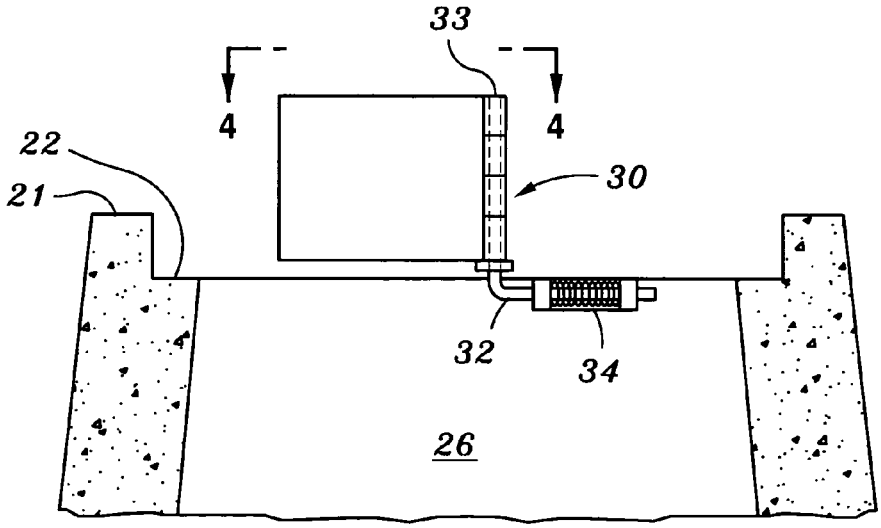
FIG. 3 is a fragmentary view as in FIG. 2, with the cover off.
Figure 4:
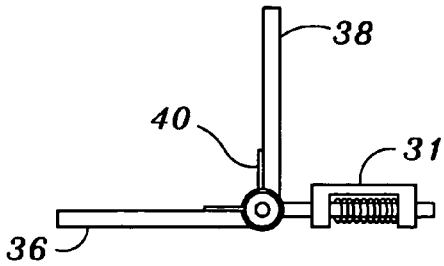
FIG. 4 is a fragmentary top view taken at line 4—4 in FIG. 3.

FIGS. 1 and 2 show a sub-grade structure 10 (a "vault") intended to be placed in and surrounded by the ground 11, at and below grade. While it can have any desired perimeter, usually the vault will be a rectangular structure, often tapered. It has a peripheral sidewall 12 with a bottom edge 13 to form a cavity open at the top. The vault may have an integral complete bottom, but more often will have either a partial bottom, or merely be open, with a bed of gravel beneath it to serve as a drain.

For some installations, such as for cable or pipe junctions and for plumbing components, openings 14 can be provided through the sidewall to give access to the vault for cables, tubes, pipes or parts. The bottom end will generally have a reinforcing flange 16 around its perimeter. The vault often holds various kinds of equipment which are to be housed and protected from the elements and from vandalism.

The upper end of the vault terminates at a rim 20 which includes a top surface 21 and a stepped down shelf 22. The shelf forms a reinforcement for the shape of the upper end. The shelf also functions as a support for a removable cover 25 that fits within the rim. Preferably the cover makes a close fit inside the rim to close the cavity 26 inside the vault.

If desired, a hinge (not shown) can hingedly mount the cover to the vault. This will not be the most common arrangement, because the cover would be in the way when work is being done inside the cavity. Usually it will be removed and placed temporarily to one side while the work proceeds, of course this can lead to a later undesired open vault.

A warning device 30 according to this invention is shown mounted to the sidewall at shelf 22. A hinge plate 31 is fastened to the shelf. A hinge pin 32 is fitted to the hinged plate. A spine 33 is integral with the hinge pin and extends at a right angle to it. A bias spring 34 biases the spine toward the upper, deployed position shown in FIG. 1.

A placard 35 is mounted to spine 33. In the simplest embodiment of this invention, the placard may be a single sheet 36 with a hinge tube 37 along one edge fitted over the spine. While a single sheet is useful and within the scope of this invention, it lacks ready visibility for a person aligned with it.

Accordingly, as shown in FIG. 1, a second sheet 38 is preferably provided with a hinge tube 39. It is also hinged to the spine.

A bias spring 40 is provided which bears against both sheets to bias them apart. It permits them to be pressed together against the spring's force for storage if a folded condition is needed to fit into the vault. A suitable stop (not shown) will limit the separation of the sheets to about a 90 degree angle dihedral, thereby to provide good visibility of the placard from all directions.

The placards will preferably be of a vivid color, often a shade of red, and can bear cautionary words.

When the cover is removed, the device will rise to its deployed position shown in FIG. 1, the spine having risen and the sheets spread apart. When the cover is to be replaced, the sheets will be folded together (if necessary) and the spine rotated down with them, and the cover will be applied.

The device is then positively held down by the cover as shown in FIG. 2. Because of the spring bias on the spine, the device will promptly be deployed by the stored mechanical energy when the cover is released or removed.

Figure 5:
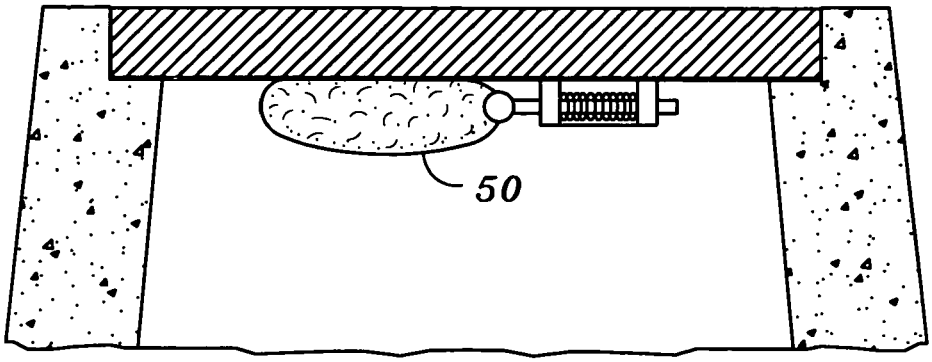
Figure 6:
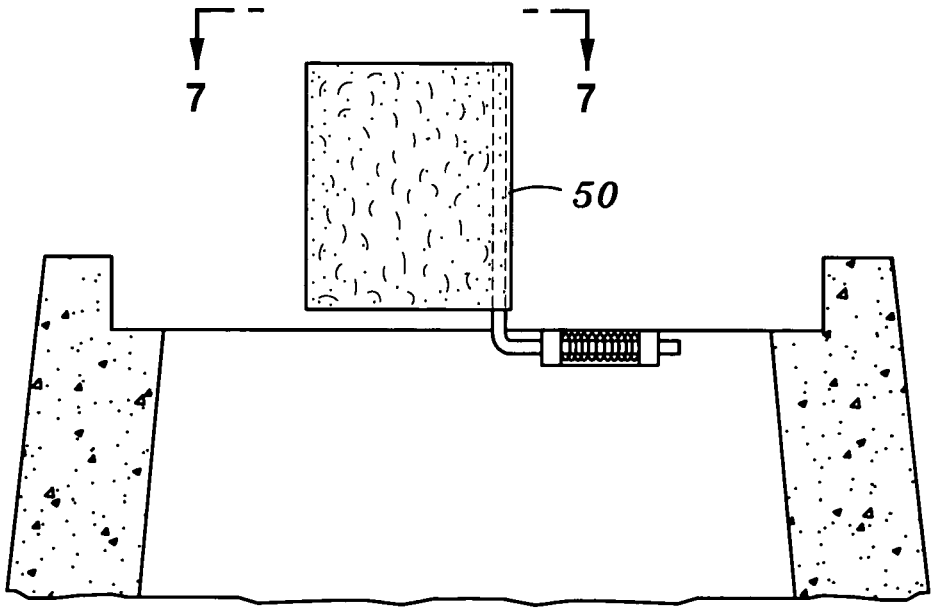
FIG. 6 is a view similar to FIG. 5 with the cover off.
Figure 7:
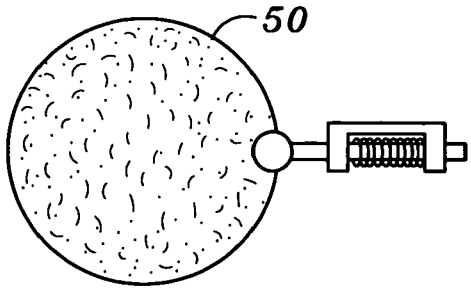
FIG. 7 is a fragmentary top view taken at line 7—7 in FIG. 6.

Instead of planar surfaces, collapsible or differently foldable structures may be used. For example, as shown in FIGS. 5–7, the placard may be a collapsible cylinder 50 mounted to a spine. The cylindrical shape will be restored by the inherent springiness of its material. It can be collapsed by side forces exerted on it as shown in FIG. 5 if collapse is necessary. Should there be sufficient room in the cavity, the placard on the cylinder need not be collapsible or foldable-merely being accommodated in the cavity when the spine is pressed down and the cover replaced.

If desired, an actuator such a wireless transmitter 61 such as an automatic telephone dialer may be connected to the spine so as to be activated by deployment of the spine. Other typical intrusion-response circuitry may be used instead. These give warning to a distant station that the cover has been raised or removed. Similarly, a lamp (not shown) in the vault may be energized to light up at that time to make the cavity visible at night. In both situations, a power supply such as a dry cell battery will be provided in the vault.

This invention is not to be limited by the embodiments shown in the drawings and described in the description, which are given by way of example and not of limitation, but only in accordance with the scope of the appended claims.

What is claimed is:

1. In combination:

a sub-grade structure having a peripheral sidewall including an upper rim forming an open top above a cavity inside said wall;

a cover adapted to fit in said open top to close said cavity; and a warning device so disposed and arranged as to give visual notice of the open condition of said open top when the cover is raised or removed, said device comprising a hinge plate mounted to said upper rim inside said cavity; a hinge pin rotatably fitted in said hinge base; a spine on said hinge pin rotatable between an upper deployed position and a lower position below said rim; a placard mounted to said spine; and bias means biasing said spine toward its deployed position;

whereby with the cover laid atop said rim, the spine and placard will be held in the cavity, spring-loaded against the cover, and when the cover is raised or removed, the spine and placard will rise above the rim.

2. A combination according to claim 1 in which said placard comprises a pair of sheets, both hinged to said spine, said sheets being biased apart so as to be visible from various directions, at least one of said sheets being rotatable to fit against the other said sheet when the cover is in place.

3. A combination according to claim 1 in which said placard comprises a cylindrical body.

4. A combination according to claim 3 in which said cylindrical body is collapsible.

5. A combination according to claim 1 in which an actuator is operatively connected to said spine to provide a signal to alert a distant supervisor.

6. A combination according to claim 5 in which said actuator is an automatic telephone dialer.

7. A combination according to claim 5 in which said actuator is a switch to cause illumination of a lamp.

8. A warning device according to claim 1 to alert the open condition of a sub-grade structure comprising:

a hinge mountable to said structure including a warning placard and a spine, said spine being spring-loaded toward an erect position and able to be depressed when a cover is applied to it.

9. A warning device according to claim 8 in which an actuator is operatively connected to said spine to provide a signal to a distant supervisor.

10. A warning device according to claim 9 in which said actuator is an automatic telephone dialer.

11. A warning device according to claim 9 in which said actuator is a switch to cause illumination of a lamp.

* * * * *